US005517839A

United States Patent [19]

Parsons

[11] Patent Number: 5,517,839

[45] Date of Patent: May 21, 1996

[54] DETACHABLE KEY RING

[75] Inventor: Kevin L. Parsons, Appleton, Wis.

[73] Assignee: Armament Systems and Procedures, Appleton, Wis.

[21] Appl. No.: 346,758

[22] Filed: Nov. 30, 1994

[51] Int. Cl.[6] ..... A47G 29/10

[52] U.S. Cl. ..... 70/456 R; 24/2.5; 24/3.6; 70/459

[58] Field of Search ..... 70/456 R, 459, 70/460; 24/2.5, 3.6, 653, 656; D3/207, 208, 209, 210; 206/37.1, 37.4, 37.5, 37.6, 37.7, 37.8, 38.1

[56] References Cited

U.S. PATENT DOCUMENTS

| | | | |
|---|---|---|---|
| 2,615,324 | 10/1952 | Meeker | 70/459 |
| 2,633,012 | 3/1953 | Johnstone | 70/459 |
| 2,916,907 | 12/1959 | Bridwell | 70/459 |
| 2,923,045 | 2/1960 | Mount | 70/459 |
| 4,419,874 | 12/1983 | Brentini | 70/459 |
| 4,505,012 | 3/1985 | Johnson | 24/2.5 X |
| 4,752,072 | 6/1988 | Parsons | 70/456 R X |
| 5,067,267 | 11/1991 | Ives | 24/2.5 X |

*Primary Examiner*—Lloyd A. Gall
*Attorney, Agent, or Firm*—Robert C. Curfiss; Bulter & Binion

[57] ABSTRACT

A detachable key ring includes a durable mounting block with a typical key ring fastened to one end and a reliably securable latching device at the opposite end which is movable between open and closed positions and includes a biasing element for holding the latching device in the closed position. The detachable key ring includes an integral member for selectively maintaining the latching device in the open position and requires a two step process to open the latch. Also, the latch mechanism is unidirectional in function. The detachable key ring may be connected to an interlocking block having a second key ring fastened at one end to form a double-ended detachable key ring.

7 Claims, 2 Drawing Sheets

FIG. 1
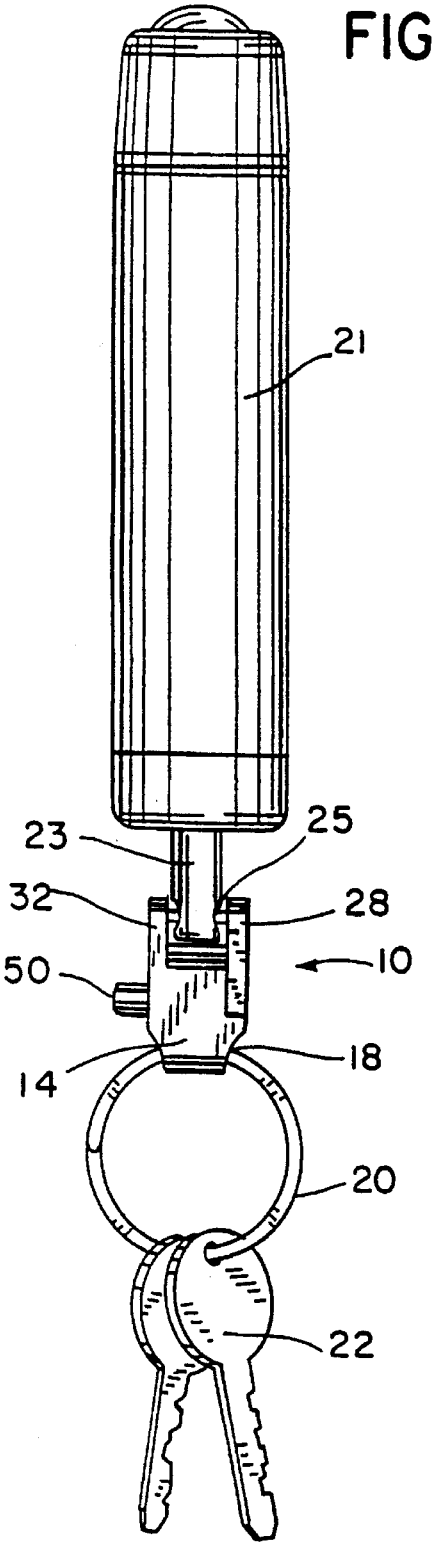
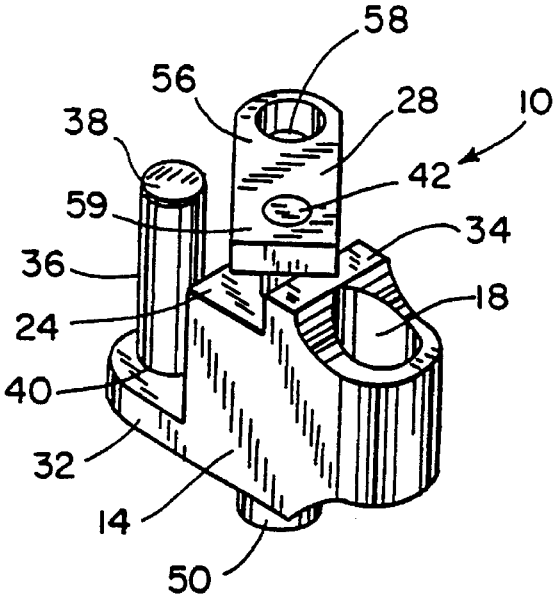
FIG. 2

FIG. 3
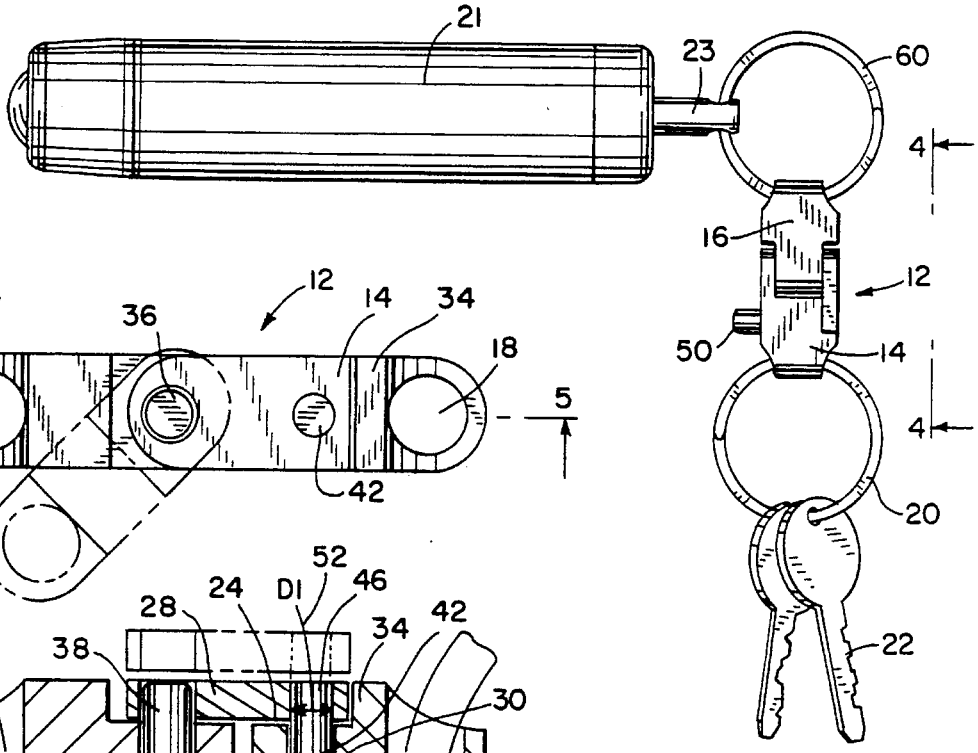
FIG. 4
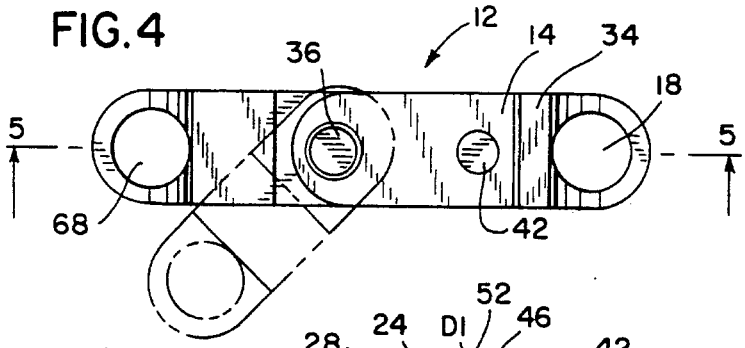
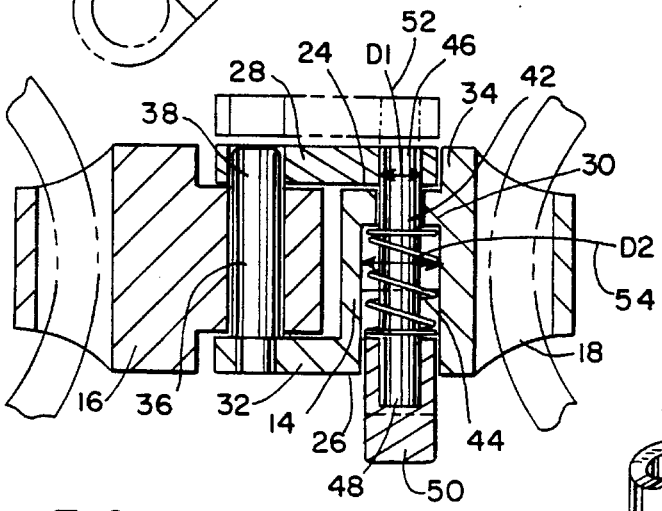
FIG. 5
FIG. 6
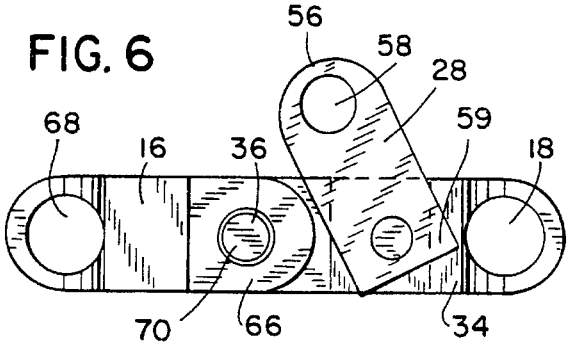
FIG. 7
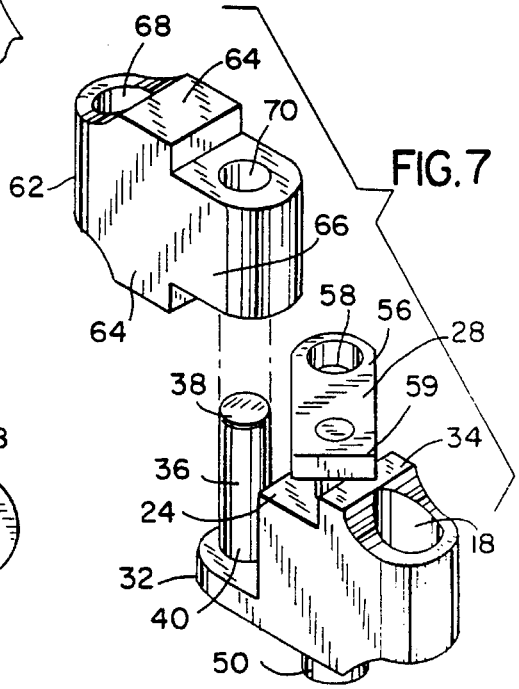

DETACHABLE KEY RING

BACKGROUND OF INVENTION

Field of Invention

The subject invention is generally related to key rings or holders and is specifically directed to a detachable key ring which is designed having a hold open feature. An optional complementary key ring holder may be provided for creating a dual detachable key ring.

Description of the Prior Art

A wide variety of detachable key holders are well known. Typical key holders include a central housing with a split ring key ring fastened at one end and a releasable latching means at the opposite end. The releasable latching means allows the user to removably attach the keys to another object such as a belt, tool, decorative key chain, key ring or other device.

The key holder may be releasably attached to another key holder to form a double ended key holder assembly so that one set of keys may be quickly and easily segregated from another set of keys. For example, automobile keys may be placed on one key ring fastened to one end of the key holder assembly and house keys may be placed on a separate key ring fastened to the other end of the key holder assembly. Thus, the automobile keys may remain on the key ring yet are easily detached from the key holder assembly, for example when the automobile is taken in for service while the house keys may remain on in the possession of the owner.

Most prior art detachable key holders are spring actuated so that the latching means is biased to remain secured in the closed position. Typically, the holder is detached by pressing a button or pushing or pulling the latch to overcome the pressure exerted by the spring to create a gap. A disadvantage of the prior art latching means is that the spring forces the latch to automatically return to the closed position unless the user continues to exert the required pressure. Thus, it may be difficult to reconnect the holder to the desired object.

While prior art detachable key rings have gained acceptance for use in certain applications, such as by way of example, convenient holders for typical consumers, custodial use and the like, the design and strength limitations do not permit use in specific fields where detachable key holders would be desirable. For example, in personal defense and in law enforcement, it is desirable to attach key rings to certain implements such as expandable batons, mace dispensers and the like. The use of a detachable key ring would permit the implement to be readily separated from the key ring without spreading the ring. In addition, it would assure that the assembled keys remain intact.

Further, in certain circumstances, it has been found that the keys can be grasped as a handle, allowing the attached implement to be used as a flail. The detachable key rings of the prior art are generally deficient for such applications because they do not have sufficient strength to hold together under such arduous conditions, are cumbersome to open and close, particularly during emergencies when time is of the essence, and in almost all cases require two hand operation. Further, because the prior art latching means requires only one movement to "open" the latch, another disadvantage of the prior art key holders is that the holder may accidently disengage and the keys may be dropped or lost.

Therefore, there is a need for a detachable key ring which includes a reliably secured latching means with a hold open feature, is sufficiently strong for use as a flail and may be combined to create a double-ended dual detachable key ring.

SUMMARY OF THE INVENTION

The subject invention is directed to a detachable key ring which is quickly and easily detachable yet reliably secured, includes a latch with a unique hold open feature, has sufficient strength for assuming that the latch is not accidentally or prematurely opened and may be used as a flail. The detachable key ring of the subject invention may include a complementary key ring holder for creating a double-ended dual detachable key ring. The detachable key ring includes a latching means designed to prevent accidental detachment by requiring a two step process to release the latch, while at the same time allowing single hand use.

In the preferred embodiment, the detachable key ring includes a mounting block with a through hole at one end for attaching a typical key ring and a latch at the opposite end for releasably securing an item to the block. For example, the detachable key ring may be used in connection with a key ring baton such as the baton shown in U.S. Pat. No. 4,752,072.

The latch is movable between an open and closed position and forms a closed loop with the block when the latch is in the closed position. The invention includes a biasing means, such as a spring, for holding the latch in the normally closed position. A release, such as a button release, is also included for moving the latch by overcoming the pressure exerted by the spring.

An important feature of the subject invention is an integral means for selectively holding the latch in the open position. In order to initiate the opening of the latch, the button is pressed to raise the latch. However, the gap created by raising the latch is not sufficient to release a secured item or to allow another item to be attached to the block. Therefore, a second step in which the raised latch is pivoted in either direction is required to move the latch to the full open position for receiving or removing an item. When the raised latch is pivoted, a portion of the latch contacts a raised section of the block and forces the latch to remain in the open position. To close the latch, the raised latch is pivoted so that the portion loses contact with the raised section and the spring biases the latch to its closed position.

The subject invention may also include a complementary key ring holder for creating a double-ended dual detachable key ring. In the preferred embodiment, the complementary key ring holder includes an interlocking block with a through hole at one end for fastening a typical key ring and a through passageway at the opposite end for attaching the interlocking block to the main block. The interlocking block is shaped to form a substantially rectangular shaped holder with the key rings at opposite ends when the interlocking block is connected to the main block. The dual detachable key ring provides a key holder assembly for quickly and easily segregating one set of keys on one key ring from another set of keys or other item held on the second key ring.

It is an additional feature of the detachable key ring of the subject invention that the latch mechanism is unidirectional in function. Specifically, if the key ring is grasped by the palm of the hand in one orientation, it is simple to manipulate and open with the thumb and one finger. Conversely, if the key ring is held in the opposite orientation, it is almost impossible to open, even with two hands. This is important for defensive or law enforcement applications, since proper orientation of the key ring to the individual using it ensures that a pursued party will not be able to readily disengage the key ring or the implement from the proper user.

Therefore, it is an object and feature of the subject invention to provide a detachable key ring which has increased strength, is quickly and easily detachable yet reliably secured and includes a latch with a hold open feature.

It is also an object and feature of the subject invention to provide a detachable key ring with a typical key ring fastened to one end and a latching means at the opposite end.

It is another object and feature of the subject invention to provide a detachable key ring which is reliably secured by requiring a two step process to release the latch.

It is a further object and feature of the subject invention to provide a detachable key ring which includes a mounting block with a latch which is movable between an open and closed position and includes a biasing means for holding the latch in the closed position.

It is yet another object and feature of the subject invention to provide a detachable key ring which includes an integral means for selectively holding the latch in the open position.

It is also an object and feature of the subject invention to provide a detachable key ring and a complementary key ring holder which can be interlocked with the detachable key ring to form a double-ended dual detachable key ring.

It is a further object and feature of the subject invention to provide a complementary key ring holder which can be quickly and easily detached and includes an interlocking block with a typical key ring fastened to one end and a through passageway at the opposite end for connecting it with the mounting block.

It is a further object and feature of the subject invention to provide a detachable key ring with a latch mechanism which is unidirectional in function.

It is yet another object and feature of the subject invention to provide an interlocking block shaped to form a substantially rectangular double-ended dual detachable key ring when connected to the mounting block.

Other objects and features will be readily apparent from the accompanying drawings and description.

BRIEF DESCRIPTION OF THE DRAWINGS

FIG. 1 is a perspective view of a detachable key ring carrying a set of keys and attached to a key ring baton.

FIG. 2 is a perspective view of the main block of the detachable key ring without the ring and showing the pivotable latch in the open position.

FIG. 3 is a perspective view of the detachable key ring in combination with a second key ring to form a dual detachable key ring and showing a pair of keys on the key ring of the main block and a key ring baton attached to the key ring of the interlocking option block.

FIG. 4 is a overhead view taken along line 4—4 of FIG. 3 showing the dual detachable key ring and the pivotability of the interlocking block relative to the main block.

FIG. 5 is an enlarged cross-sectional view taken along line 5—5 of FIG. 4 showing the post, latch, interior spring and projecting release button of the main block and the interlocking block on the post with the latch in the closed position and showing the latch raised to the open position and key rings (in phantom).

FIG. 6 is an overhead view of the dual detachable key ring showing the pivotal movement of the latch in the open position, relative to the main block.

FIG. 7 is a perspective view of the main block with the latch held in the open position and the interlocking block as removed from the post of the main block.

DETAILED DESCRIPTION OF THE DRAWINGS

The preferred embodiment of the detachable key ring of the subject invention is shown in FIGS. 1 and 2 and is designated generally by the numeral 10. The detachable key ring 10 may also be used in combination with an optional block 16 to form a dual detachable key ring 12, as shown in FIGS. 3–7. The invention provides a key ring with sufficient strength to permit use as a flail yet is quickly and easily detachable by the user. Because the detachable key ring requires a two step release process, it is reliably secured and will not become accidently detached.

The detachable key ring 10 includes a body or main block 14 with a through hole 18 at one end for attaching a typical split ring key ring 20 for holding one or more keys 22. The main block 14 comprises a top side 24, a bottom side 26, a pivotable latch 28 movable between an open and a closed position and an interior cavity 30. A tab 32 extends outward from the bottom side 26 of the block and the top side 24 includes an elevated section or ridge 34 adjacent to the through hole 18. The main block 14 further includes a post 36 having a top end 38 and a bottom end 40. The bottom end 40 is secured to the tab 32 and the post 36 extends vertically from the tab so that the top end 38 is at the same height as the top surface of the ridge 34.

The detachable key ring 10 may be secured to any object which has a receiving closed loop by moving the latch 28 to the open position and inserting the post 36 through the loop and then moving the latch to the closed position. As shown in FIG. 1, the detachable key ring 10 may be attached directly to a key ring baton 21 by inserting the post 36 in the through hole 25 of the swivel member 23 at one end of the baton 21. In the preferred embodiment, the main block 14 is made of metal for extra strength and durability.

As shown in FIG. 5, the interior cavity 30 of the main block 14 houses a cylindrical shaft 42 which extends through the block 14 and a biasing means, such as a spring 44, attached to the shaft 42. The cylindrical shaft 42 has opposite ends 46 and 48 which extend beyond the top and bottom sides 24 and 26 of the block 14. An enlarged head is connected to one end 48 of the cylindrical shaft 42 and defines an actuator button 50 projecting from the bottom side 26 of the block 14. The interior cavity 30 includes an upper section 52 having a first diameter D1 sized to fit the cylindrical shaft 42 and a lower section 54 having a second diameter D2 which is larger than the diameter D1 and is sized to accommodate the button 50. As shown in FIG. 5, the spring 44 is in the lower section 54 for biasing the actuator button 50 in the projecting position and holding the latch 28 in the normally closed position.

The latch 28 is pivotably secured to the other end 46 of the cylindrical shaft 42. The end of the latch which is not secured to the shaft 42 is a free end 56 which extends outward above the tab 32 and includes an opening 58 for receiving the top end 38 of the post 36. When the latch 28 is pivoted to receive the top end 38 of the post 36, the latch 28 is seated on the top side 24 of the block 14 and the free end 56 forms a closed loop with the post 36 thereby securing the detachable key ring 10 in the closed position.

To open the latch 28, pressure is applied to the release button 50 to overcome the pressure exerted by the spring 44 thereby raising the latch 28 above the top side 24 of the block 14 and disengaging the free end 56 from the post 36. Because the diameter D1 of the upper section 52 of the interior cavity 30 is smaller than the diameter of the button, the button 50 cannot be pushed completely through the interior cavity to accidently disengage the latch 28 and shaft 42 from the main block 14.

When pivoted in either direction away from the post 36, as shown in FIGS. 6 and 7, a portion 59 of the latch 28 contacts the ridge 34 which forces the latch to remain in the open position. This hold open feature for holding the latch 28 in the open position by pivoting the portion 59 onto the ridge 34 is an important aspect of the invention. To close the block 14, the latch 28 is pivoted back toward the post 36 so that the portion 59 loses contact with the ridge 34 and the spring 44 forces the free end 56 of the latch to engage the post 36 and secures the latch in the normally closed position.

The invention may also include a second key ring 60 on an optional interlocking block 16 which connects with the main block 14 to form the dual detachable key ring 12. The dual detachable key ring 12 provides two separate key rings for carrying items and a holder which can be easily separated to detach the key rings from each other. As shown in FIG. 3, the key ring baton 21 can be fastened to key ring 60 of the interlocking block 16 while a set of keys 22 is carried on the key ring 20 of the main block 14.

As shown in FIG. 7, the option block 16 is substantially T-shaped having a top end 62, opposite outer ends 64 and a base 66. The block 16 includes a through hole 68 extending outward from the top end 62 of the substantially T-shape for receiving the second split ring key ring 60. The base 66 includes a through passageway 70 for receiving the post 36 of the main block 14 (see FIG. 7).

As shown in FIG. 5, when the post 36 is inserted into the passageway 70 and the latch 28 is in the closed position, the main block 14 and the interlocking option block 16 form a substantially rectangular shaped holder with through holes 18 and 68 at opposite ends for attaching the first and second key rings 20 and 60. As shown in FIG. 4, the dual detachable key ring is flexible since the option block 16 is pivotable, around the post 36, relative to the main block 14. The interlocking block 16 may be quickly and easily separated from the main block 14 by pressing the projecting button 50 to raise and pivot the latch 28 to the open position. Once the latch 28 is pivoted in either direction away from the post 36, the option block 16 is easily removed from the post 36 (see FIGS. 6 and 7).

An additional important feature is that the construction of the preferred embodiment makes the key ring latch mechanism substantially unidirectional. As best seen in FIGS. 2 and 7, if the key ring block 14 is held in the palm of either hand with the button 50 toward the thumb and the latch 28 away from the thumb, it is a simple maneuver to press the release button 50 with the thumb and pivot the latch to the open position with the index finger or vice versa. If the key ring block 14 is held in the opposite orientation, with the thumb adjacent the latch, it is almost impossible to open the latch. It will be noted that since the latch pivots either clockwise or counterclockwise from the post 36, the key ring is readily adapted for either left-handed or right-handed use.

While specific embodiments and features of the invention have been disclosed herein, it will be readily understood that the invention encompasses all enhancements and modifications within the scope and spirit of the following claims.

What is claimed is:

1. A detachable key holder comprising:

a. a main block having opposite ends, a top side, a bottom side and an interior cavity, said main block further including a tab extending outward from the bottom side of one end of the block and a through hole in said other end;

b. a latch connected to the block, said latch movable between an open and closed position, the latch defining a closed loop with the block when the latch is in the closed position;

c. a biasing means for holding the latch in a normally closed position;

d. an integral means for selectively maintaining the latch in the open position, said integral means defining a ridge on the top side of the block, said ridge being adjacent to said other end of the block and extending upward to a certain height above the top side;

e. a post vertically secured to the tab, said post having top and bottom ends, wherein the bottom end is secured to the tab and the top end is at the same height as the height of the ridge; and f. a split ring key ring inserted in the through hole at said other end of the main block.

2. The detachable key holder of claim 1, further comprising:

a. a cylindrical shaft having opposite ends and extending through the interior cavity wherein the latch is pivotally attached to one end of the shaft;

b. a projecting button connected to the other end of the shaft, said button projecting outward from the bottom side of the block when the latch is in the closed position;

c. wherein the biasing means is a spring attached to the shaft in the interior cavity, said spring biasing the projecting button outward and holding the latch in the closed position; and d. wherein said projecting button defines a release for moving the latch from the closed to the open position by applying pressure on the button to overcome the pressure exerted by the spring.

3. The detachable key holder of claim 2, wherein the latch has a first end and a second free end:

a. said first end being pivotally attached to the shaft and said free end extending outward over the tab and including an opening for receiving the post;

b. wherein said first end is seated on the top side of the block adjacent to the ridge and said opening in the free end engages the post to form the closed loop when the latch is in the closed position; and c. wherein said first end is raised off the top side when the projecting button is pressed and the latch is pivoted to the open position, said ridge maintaining the latch in the open position.

4. A detachable key holder comprising:

a. a main block having opposite ends, a top side, a bottom side and an interior cavity, said main block further including a tab extending outward from the bottom side of one end of the block;

b. a latch connected to the block, said latch movable between an open and closed position, the latch defining a closed loop with the block when the latch is in the closed position;

c. a biasing means for holding the latch in a normally closed position;

d. an integral means for selectively maintaining the latch in the open position, said integral means defining a ridge on the top side of the block, said ridge being adjacent to said other end of the block and extending upward to a certain height above the top side;

e. a post vertically secured to the tab, said post having top and bottom ends, wherein the bottom end is secured to the tab and the top end is at the same height as the height of the ridge; and f. an interlocking second block having a base including a through passageway for receiving the post of the main block and a top end including a through hole.

5. The detachable key holder of claim 4, wherein said second block is substantially T-shaped and wherein the main block and the interlocking block are connected to form substantially rectangular shaped holder having through holes at opposite ends when the post is inserted into the passageway and the latch is in the closed position.

6. The detachable key holder of claim 5, further including a key ring inserted in the through hole of the interlocking block.

7. The detachable key holder of claim 6, wherein the main block and the interlocking block are connected to define a dual ring detachable key ring holder.

* * * * *